United States Patent [19]

Yuge et al.

[11] 4,447,517

[45] May 8, 1984

[54] METHOD OF DEVELOPING ELECTROSTATIC LATENT IMAGES

[75] Inventors: Shizuo Yuge, Okazaki; Susumu Sakakibara, Toyohashi; Takuma Ishikawa, Toyokawa; Nobuo Kito, Hoi; Toshio Yamamoto, Sakai, all of Japan

[73] Assignee: Minolta Camera Kabushiki Kaisha, Osaka, Japan

[21] Appl. No.: 379,995

[22] Filed: May 19, 1982

[30] Foreign Application Priority Data

May 29, 1981 [JP] Japan ..... 56-83034

[51] Int. Cl.[3] ..... G03G 13/09

[52] U.S. Cl. ..... 430/122; 118/657; 324/173; 324/175; 324/225

[58] Field of Search ..... 430/122; 118/657, 658

[56] References Cited

U.S. PATENT DOCUMENTS 4,363,861 12/1982 Nakamura et al. ..... 430/122 X 4,385,829 5/1983 Nakahata et al. ..... 430/122 X

FOREIGN PATENT DOCUMENTS 2914567 10/1979 Fed. Rep. of Germany ..... 430/122

*Primary Examiner*—Roland E. Martin, Jr.

*Attorney, Agent, or Firm*—Wenderoth, Lind & Ponack

[57] ABSTRACT

The disclosure is directed to an improved electrostatic latent image developing method in which uneven development arising from simultaneous employment of a magnetic roller rotational driving system and an AC developing bias impressing system is eliminated, without impairing the advantages available from such systems, so as to make it possible to provide developed images of good quality at high density in the application, for example, to an electrophotographic copying apparatus and the like.

6 Claims, 13 Drawing Figures

METHOD OF DEVELOPING ELECTROSTATIC LATENT IMAGES

BACKGROUND OF THE INVENTION

The present invention generally relates to electrography and more particularly, to a method of developing an electrostatic latent image formed on an electrostatic latent image carrier or support member, by the employment of a magnetic brush developing device.

Conventionally, for a magnetic brush developing device, there has been proposed an arrangement in which a developing sleeve and/or a magnetic roller incorporated in the developing sleeve are driven for rotation so as to develop an electrostatic latent image formed on the surface of an electrostatic latent image support member by a developing material which is transported along the peripheral surface of the developing sleeve in the form of a magnetic brush.

With respect to the prior art developing device as described above, there is known a system in which the magnetic roller is driven for rotation for transporting the developing material over the developing sleeve for improved stirring or agitation of said developing material at a developing region, i.e. at a region where the peripheral surface of the developing sleeve most closely approaches the surface of the electrostatic latent image support member, and another system in which an AC developing bias is applied to a developing electrode (this function is mainly carrried out by the developing sleeve) for the improvement of the developing efficiency.

However, in the known systems as described above, there has been experienced such disadvantages that uneven development as shown in FIG. 1 tends to take place unless the speed of rotation of the magnetic roller is greater than a predetermined speed, and similarly, unless the frequency of the AC developing bias is greater than a predetermined value.

In connection with the above, according to the developing experiments carried out by the present inventors through simultaneous employment of both of the systems as described above, it has been found, contrary to the expectation of the present inventors, that irregular or uneven development including dark and light portions at fixed intervals takes place in the direction of movement of the photosensitive member or photoreceptor (i.e. in the direction indicated by an arrow A in FIG. 1), in spite of the fact that the speed of rotation and the frequency of the AC developing bias were made greater than the predetermined values based on the experiences as described earlier.

As shown in FIG. 2, the developing device employed for the above experiments includes an electrically conductive developing sleeve 1 having an outer diameter of 32 mm, and a magnet roller 2 magnetized with eight poles and rotatably accommodated in said developing sleeve 1, with an AC developing bias source 3 being connected to the developing sleeve 1, while a bristle height adjusting plate 5 provided at a lower side edge of a developer tank 4 defines a bristle height restricting gap of 0.25 mm with the sleeve 1. Adjacent to the developing sleeve 1, there is disposed a photoreceptor drum 6 formed by applying a photosensitive layer 6*a* of $CdS.nCdCO_3$ resin photosensitive material onto the peripheral surface of an aluminum drum, driven for rotation in the counterclockwise direction at a circumferential speed of 100 mm/sec, and arranged to have formed, on the peripheral photosensitive surface 6*a* thereof, an electrostatic latent image after having been charged to −800 V by a corona charging means (not shown). The developing gap between the sleeve 1 and drum 6 is 0.35 mm.

In the developing device as described above, when the development is effected, with the employment of a mono-component magnetic developing material as a developer, and by rotating the magnetic roller 2 in the counterclockwise direction at 1400 r.p.m. and with the impression of an AC developing bias of 2000 V (peak to peak) at 400 Hz on the developing sleeve 1 from the AC developing bias source 3, the uneven development as described with reference to FIG. 1 was produced.

The uneven development is considered to be attributable to the following causes. As shown in FIG. 3, magnetic toner 7 present at the developing region is subjected to a developing force acting in the direction to cause it to adhere to the electrostatic latent image formed on the photosensitive surface 6*a* of the photoreceptor drum 6 by magnetic action which periodically varies, following rotation of the magnetic roller 2, and also by electrical action periodically varying as the AC developing bias is impressed. The developing force as described above reaches a peak value driving periodical fluctuations of the magnetic action and electrical action as described above, thus resulting in the formation of the uneven development with dark and light portions proportional to the frequency of variation of the developing force peak value due to superposition of the two actions described above.

In connection with the above, the present inventors have carried out investigations, through experiments, into the individual variation of the developing force arising from the magnetic action and the electrical action referred to above, and also into the variation of the developing force due to superposition of the above two actions, with findings as follows.

More specifically, in the case where development is effected by rotating the magnetic roller at 1400 r.p.m., without impression of the AC developing bias, the developing force due to the magnetic action varies at a period $t_1$ of 5.36 msec. as shown in FIG. 4. When the developing sleeve is driven for rotation at a proper speed in the clockwise direction and simultaneously an AC developing bias of 400 Hz is applied, with the magnetic roller held stationary, the developing force due to electrical action varies at a period $t_2$ of 2.50 msec. as shown in FIG. 5. During impression of AC develop bias at 400 Hz, with the magnetic roller being driven for rotation at 1400 r.p.m., the peak value of the developing force due to superposition of the two actions (in the form of a beat frequency) varies at a period $t_3$ of 37.6 msec. as shown in FIG. 6.

The uneven development does not take place in the cases of the periods $t_1$ and $t_2$, but is formed in the case of the period $t_3$ as shown in FIG. 1, and the interval $l_1$ between the dark portions in the uneven development is 3.76 mm ($l_1 = t_3 \cdot V$) i.e. the product of the period $t_3$ of developing force variation and the circumferential speed V of the photoreceptor drum.

In connection with the above, it has been found in the developing experiments carried out by the present inventors, that whether or not the uneven development as described above takes place depends on the relation between the substantial developing time and the period of the developing force peak value, and more specifically, that if the substantial developing time is longer than the period of the developing force peak value, the uneven development does not take place, while on the contrary, if such substantial developing time is shorter than the period of the developing force peak value, uneven development is undesirably produced.

It should be noted here that the above named "substantial developing time" which is a conception newly defined by the present inventors means the time which is required for one predetermined point on the surface of an electrostatic latent image support member to pass a developing region wherein the electrostatic latent image is substantially developed, and which is peculiar to each magnetic brush developing device. More specifically, the substantial developing time as described above is obtained for a particular magnetic brush developing device by developing an electrostatic latent image while varying the speed of rotation of the magnetic roller without impression of an AC developing bias so as to find a value of the minimum speed of rotation R (in rpm's) at which the formation of the uneven development as shown in FIG. 1 is eliminated, from which the substantial developing time is determined from the following equation:

$$Td=(6/R\cdot p)\times 10^4 \quad (3)$$

where

Td: substantial developing time (msec.)

R: minimum speed of rotation (r.p.m)

p: number of poles of the magnetic roller.

The substantial developing time as described above varies according to kinds of developing materials employed, the developing gap and moving speed of the electrostatic latent image support member. For example, in the developing device shown in FIG. 2, the minimum number of revolutions R is found to be 300 r.p.m., and when R=300 and p=8 are substituted into the above equation (3), the substantial developing time Td works out to be 25 msec.

Accordingly, in the case where the periods $t_1$ and $t_2$ are 5.36 msec. and 2.50 msec., and shorter than the substantial developing time Td at 25 msec. (FIGS. 4 and 5), i.e. when the variations of the magnetic and electrical developing forces are not superposed on each other, the uneven development does not take place, while in the case where the period $t_3$ is 37.6 msec. (FIG. 6), i.e. when the variations of the magnetic and electrical developing forces are superposed on each other, undesirable uneven development is produced.

SUMMARY OF THE INVENTION

Accordingly, an essential object of the present invention is to provide an electrostatic latent image developing method in which uneven development resulting from simultaneous employment of the magnetic roller rotational driving system and an AC developing bias impressing system is eliminated, without impairing the advantages available from these systems, so as to make it possible to obtain developed images of favorable image quality at high density, with substantial elimination of the disadvantages inherent in the conventional developing methods of this kind.

Another important object of the present invention is to provide an electrostatic latent image developing method as described above which has simple procedures and is efficient in operation, and can be readily applied to electrophotographic copying apparatuses of this type.

In accomplishing these and other objects, according to one preferred embodiment of the present invention, there is provided a method of developing electrostatic latent images formed on the surface of an electrostatic latent image support member by employment of a magnetic brush developing device having a developing sleeve having an AC developing bias impressed thereon and a magnetic roller provided in the developing sleeve so as to be driven for rotation within the developing sleeve. The developing method includes the step of adjusting the speed of rotation of the magnetic roller and the frequency of the AC developing bias so as to satisfy conditions represented by following equations.

$$nt_1=mt_2 \quad (1)$$

$$nt_1(mt_2)\leqq Td \quad (2)$$

where $t_1$: period (msec.) of variation of the magnetic action due to rotation of the magnetic roller, $t_2$: period (msec.) of variation of the electrical action due to the impression of the AC developing bias, n, m: integers having no common division other than 1, Td: substantial developing time (msec.), thereby the period of the developing force peak value is set so as to be no longer than the substantial developing time.

By the step of the present invention as described above, an improved method of developing electrostatic latent images has been provided.

BRIEF DESCRIPTION OF THE DRAWINGS

These and other objects and features of the present invention will become apparent from the following description of a preferred embodiment thereof with reference to the accompanying drawings, in which.

Before the description of the present invention proceeds, it is to be noted that like parts are designated by like reference numerals throughout the several views of the accompanying drawings.

DETAILED DESCRIPTION OF THE INVENTION

Figure 2:
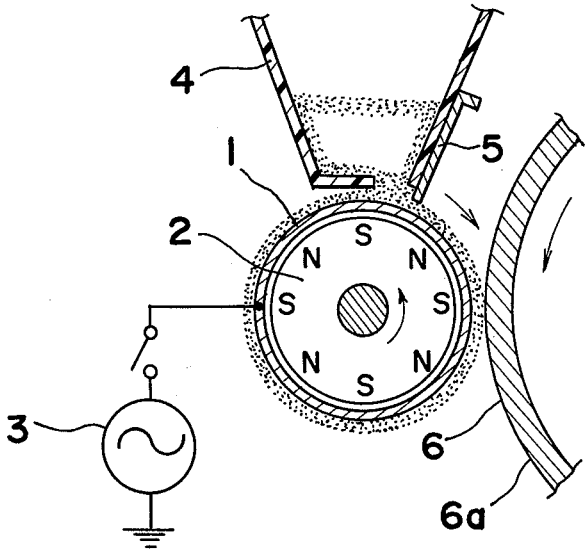
FIG. 2 is a schematic side sectional view of a magnetic brush developing device employed in the developing experiments carried out by the present inventors (already referred to)
Figure 3:
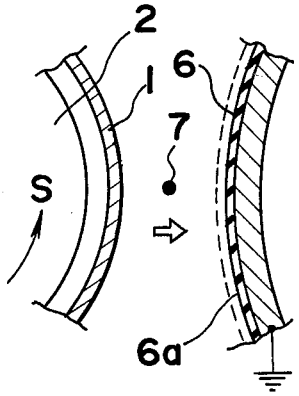
FIG. 3 is a fragmentary side sectional view, on an enlarged scale, of a developing sleeve and a photoreceptor drum for explaining the state of development.
Figure 4:
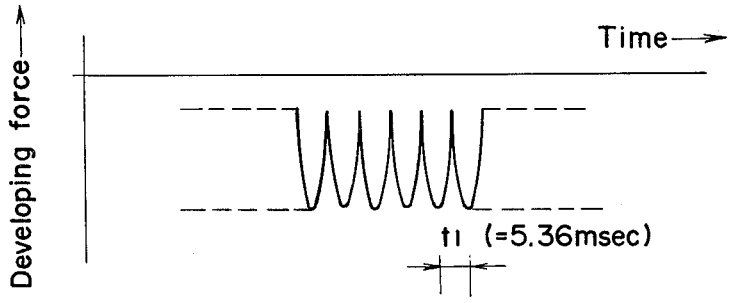
FIGS. 4, 5 and 6 are graphs showing variations of developing force.
Figure 5:
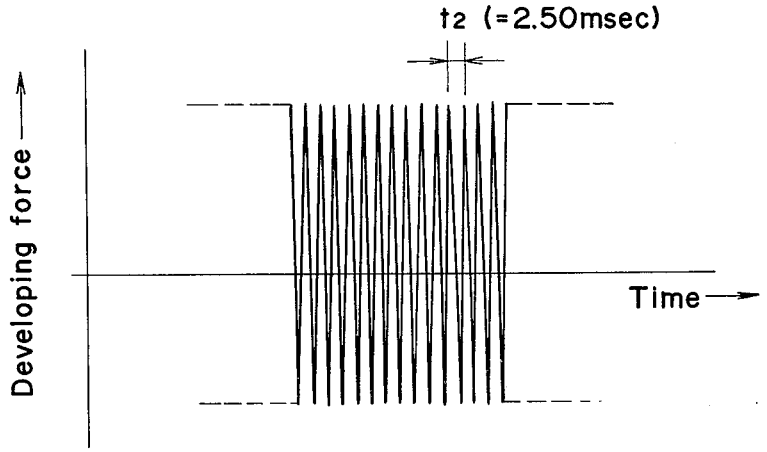
Figure 6:
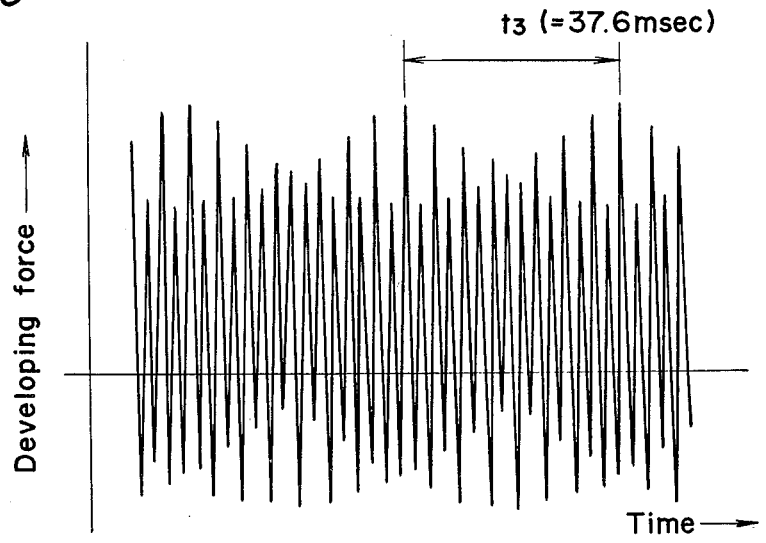
Figure 7:
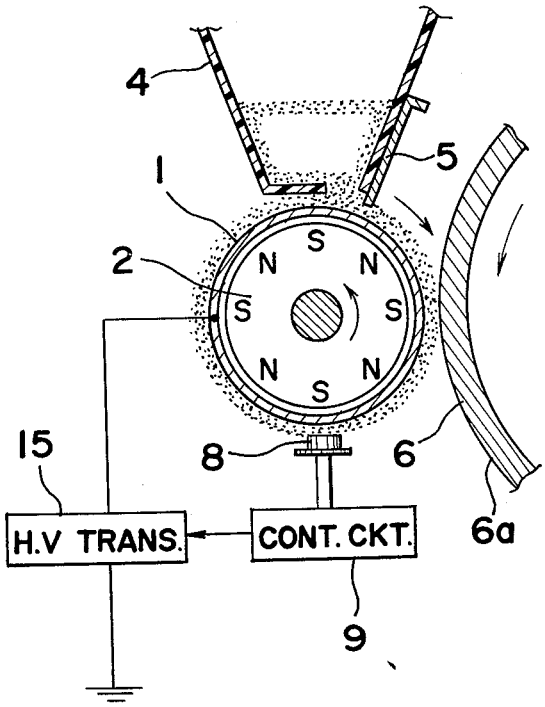
FIG. 7 is a schematic side sectional view of a magnetic brush developing device which can be employed for effecting the electrostatic latent image developing method according to the present invention.

Referring now to the drawings, there is shown in FIG. 7 a magnetic brush developing device which can be used to practice the electrostatic latent image developing method according to the present invention, which generally includes the electrically conductive developing sleeve 1 in which the magnetic roller 2 magnetized, for example, with eight poles is rotatably accommodated and which is disposed adjacent to the photosensitive surface 6a of the photoreceptor drum 6, the developer tank 4 disposed above the photoreceptor drum 6, and the bristle height adjusting plate 5 fixed to the lower side edge of the tank 4 in a manner similar to the arrangement of FIG. 2. Immediately below the end portion of the developing sleeve 1, there is disposed a magnetic force variation detecting element 8 such as a Hall element, inductance element or the like, the detection output of which element 8 is coupled to a control circuit 9 for being amplified thereat and applied to a high voltage transformer 15, which is further connected to the developing sleeve 1 for impressing an AC developing bias on said sleeve 1.

According to the present invention, the period of the developing force peak value produced by the superposition of the magnetic action owing to rotation of the magnetic roller 2 and the electrical action due to the impression of the AC developing bias, is set so as to be below the substantial developing time Td (according to the present embodiment, Td: 25 msec. as described earlier), and the period is adjusted by properly setting the speed of rotation of the magnetic roller 2 and the frequency of the AC developing bias. According to the present embodiment described so far, in order to prevent deviations in the above set values due to any deviation in the speed of rotation of the magnet roller 2 or any deviation in the frequency of the AC developing bias, the frequency of the AC developing bias is controlled by detection of the magnetic action which periodically varies according to the speed of rotation of the magnetic roller 2, i.e. according to rotation of said magnetic roller 2, by the magnetic force variation detecting element 8.

Figure 8:
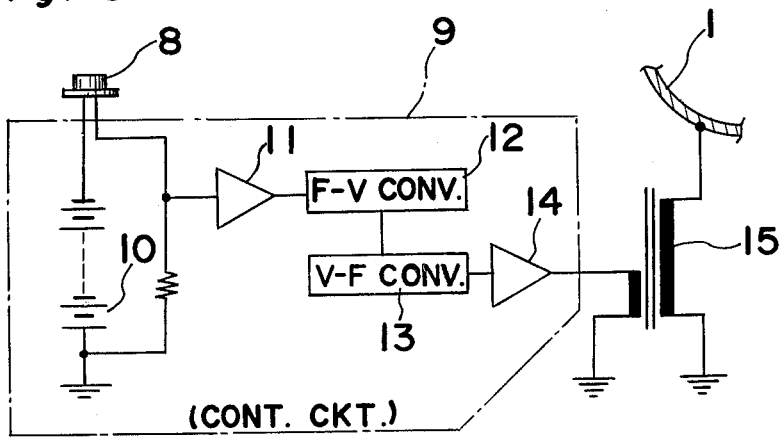
FIG. 8 is a block diagram showing the construction of a control circuit employed in the arrangement of FIG. 7, FIGS. 9 and 10 are graphs showing periods of rotation of the magnetic roller and frequencies of the AC developing bias respectively.

As shown in FIG. 8, the control circuit 9 includes a power source 10 coupled to the magnetic force variation detecting element 8, an amplifier 11 connected, at its input side, to one terminal of the element 8 for amplification of the output of said element 8, and at its output side to an F-V converter 12, a V-F converter 13 connected to the converter 12, and an amplifier 14 connected, at its input, to the converter 13 for amplification of the output of said converter 13, with the output of the amplifier 14 being connected to the input of the high voltage transformer 15 the output of which is connected to the developing sleeve 1 for application of the AC developing bias to said sleeve 1 as described earlier.

Figure 1:
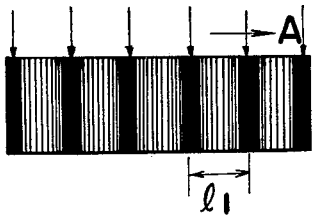
FIG. 1 is a schematic diagram representing the state of uneven development which appears in solid-black developed images (already referred to)

More specifically, when the speed of rotation of the magnetic roller 2 is set at 1400 r.p.m., magnetic force variation at a frequency $fm = 1400 \times 8/60$ Hz is detected by the magnetic force variation detecting element 8. With respect to the above an AC developing bias of 3·fm Hz is impressed on the developing sleeve 1 at a voltage of 2000 V (peak-peak). The period of peaks of the developing force value in this case is 5.36 msec., and thus, the uneven development as shown in FIG. 1 was eliminated, while developed images of favorable image quality were obtained at high density, due to the advantages obtained by the driving of the magnetic roller 2 and impression of the AC developing bias at said values.

It is to be noted here that the speed of rotation of the magnetic roller and the frequency of the AC developing bias should be adjusted so as to satisfy the conditions represented by the following equations.

$$nt_1 = mt_2 \quad (1)$$

$$nt_1(mt_2) \leqq Td \quad (2)$$

where $t_1$: period (msec.) of variation of the magnetic action due to rotation of the magnetic roller, $t_2$: period (msec.) of variation of the electrical action due to the impression of the AC developing bias, n, m: integers having no common divisor other than 1, Td: substantial developing time (msec.).

Needless to say, the output frequency of the V-F converter 13 in the control circuit 9 as described earlier is so adjusted that the conditions for the equations (1) and (2) are satisfied.

In connection with the above, there are given in Table 1 below, examples of frequencies for the AC developing bias in which periods of the developing force peak value become shorter than the substantial developing time (25 msec.), where the speed of rotation of the magnet roller 2 is set at 1400 r.p.m.

TABLE 1

| Period of developing force Peak value (msec.) | Period of undulation (msec.) | n | m |
|---|---|---|---|
| * 187 (= 1.0 · fm) | 5.36 | 1 | 1 |
| 280 (= 1.5 · fm) | 10.7 | 2 | 3 |
| * 373 (= 2.0 · fm) | 5.36 | 1 | 2 |
| 467 (= 2.5 · fm) | 10.7 | 2 | 5 |
| * 560 (= 3.0 · fm) | 5.36 | 1 | 3 |
| 653 (= 3.5 · fm) | 10.7 | 2 | 7 |
| * 747 (= 4.0 · fm) | 5.36 | 1 | 4 |

fm: magnetic force variation frequency

In the above case, from the viewpoint of actual application, since there is a certain limitation to the increase in the speed of rotation of the magnetic roller 2, it is preferred to set the integers n and m described earlier at n=1 or 2 and m=1, 2, 3 and so forth in the actual practice.

Figure 9:
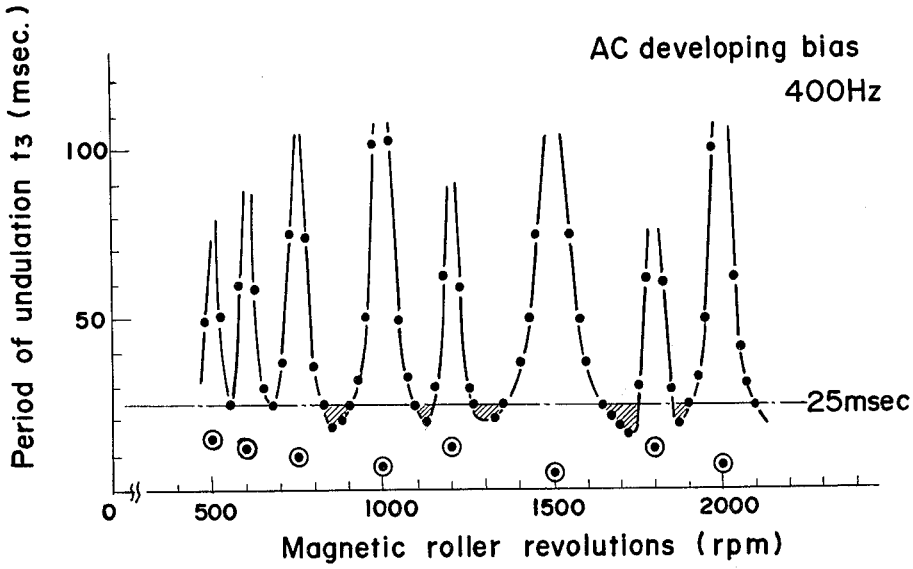
Figure 10:
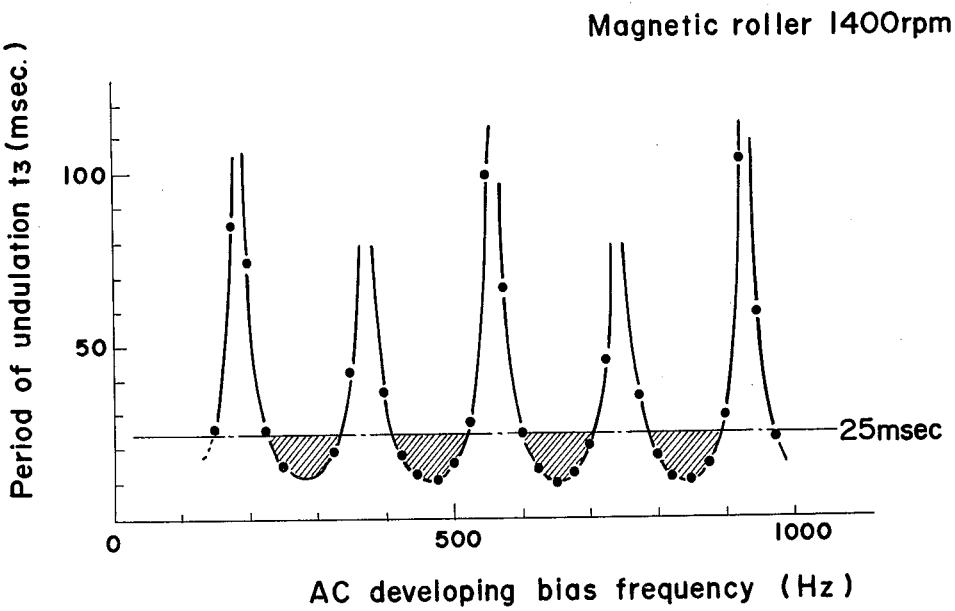

On the other hand, for keeping the developing force peak value period $t_3$ to a minimum (which may be achieved when the integer n or m is 1), it is preferable to add the control circuit 9 for the AC developing bias frequency as in the present embodiment, because when setting the values to keep the developing force peak value period $t_3$ to a minimum, a long period tends to occur, following variation of the set value as shown in FIGS. 9 and 10.

FIG. 9 shows results of actual measurements taken of the period $t_3$ by varying the speed of rotation of the magnetic roller from 25 to 50 r.p.m., with the frequency for the AC developing bias being fixed at 400 Hz, while FIG. 10 represents results of actual measurements taken of the period $t_3$ by varying the frequencies of the AC developing bias from 25 to 50 Hz, with the speed of rotation of the magnetic roller being fixed at 1400 r.p.m. In each of the graphs of FIGS. 9 and 10, actual measuring points are denoted by black points •, which are connected to each other by imaginary solid lines. In the graphs as described above, at portions represented by marks ⊙ and hatched portions, the periods $t_3$ become shorter than 25 msec., and thus, the conditions that this period be below the substantial developing time are satisfied, thereby avoiding formation of the undesirable uneven development. It should be noted here that the conditions represented by the equations (1) and (2) described earlier are satisfied at the actual measuring points denoted by the marks ⊙ in FIG. 9, although, in FIG. 10, the periods of developing force peak value are not actually measured at the points for satisfying the conditions of the equations (1) and (2), owing to the nature of the experiments.

It is to be noted here that, needless to say, in the graphs of FIGS. 9 and 10, not all of the points ⊙ are shown which are to be covered by the appended claims.

It should also be noted here that even when the conditions of the equations (1) and (2) are not satisfied, it is possible that the actually measured development force peak value period may appear to be below the substantial developing time, but in such a case, it should be understood, in the strict sense, that another variation with an extremely small amplitude and longer than the substantial developing time is being separately produced. On the contrary, in the case where the conditions of the equations (1) and (2) are satisfied, since the development force peak to value period itself for a maximum period which may be produced theoretically becomes completely below the substantial developing time, the variation development force peak value as described earlier is not generated, and the state may be regarded as ideal.

Meanwhile, as a result of developing experiments carried out under the conditions marked with * in Table 1, without installation of the control circuit 9 and with frequencies of the AC developing bias being fixed at 187, 373, 560 and 747 Hz respectively, uneven development tends to be noticed owing to irregular revolutions, etc. of the magnetic roller. The above inconvenience can be attributable to the fact that, at the frequencies as described above, the period of development force peak value fluctuates largely due to the irregular revolutions of the magnetic roller, etc., and therefore, installation of the control circuit 9 as described earlier is desirable.

On the other hand, when the developing experiments were carried out under the conditions not marked with * in Table 1, without installation of the control circuit 9, and with the frequencies of the AC developing bias being fixed at 280, 467, and 653 Hz, substantially no uneven development was produced. The frequencies as described above are equivalent to the regions represented by the hatched portions in FIG. 10, in which there are no particularly large variations of the period due to the irregular revolutions of the magnetic roller, etc.

Figure 11:
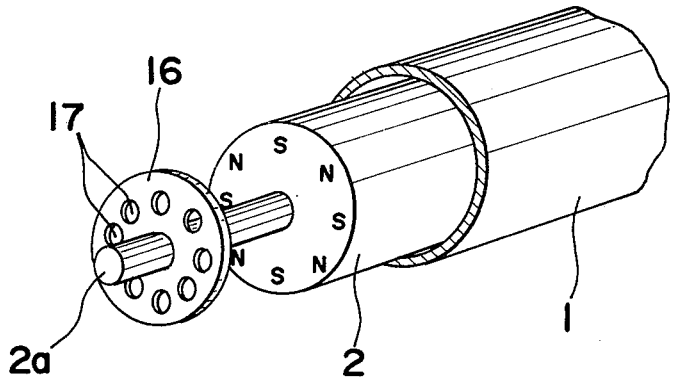
FIG. 11 is a fragmentary perspective view showing a modification of the magent member and developing sleeve in the arrangement of FIG. 7.
Figure 12:
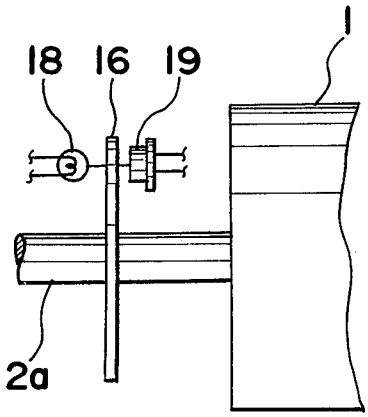
FIG. 12 is a fragmentary side elevational view of the magnet member and developing sleeve of FIG. 11 incorporated in the arrangement of FIG. 7.

Referring now to FIGS. 11 and 12, there is shown a modification of the arrangement of FIG. 7. In this modification intended to detect magnetic force variation due to rotation of the magnetic roller 2, a rotary disc 16 provided with a plurality of openings 17 corresponding in positions to the magnetic poles of the magnetic roller 2 is fixedly mounted on the shaft 2*a* of said magnetic roller 2, while a light source 18 and a photoelectric element 19 are provided on opposite sides of the rotary disc 16 so as to be opposed to each other through each of the openings 17 on the axis of said openings 17.

In the above arrangement of FIGS. 11 and 12, upon rotation of the magnet roller 2, the photoelectric element 19 is actuated by light from the light source 18 intermittently passing through the openings 17 of the rotary disc 16 which is rotated as one unit with the magnetic roller 2 for the detection of the magnetic force variation. The output of the photoelectric element 19 is processed through the control circuit 9 as described with reference to FIG. 8.

It is to be noted here that, for maintaining the period of developing force peak value constant, rather than controlling the frequency of the AC developing bias, it is also possible to control the speed of rotation of the magnetic roller through detection of any variation in the frequency of the AC developing bias, i.e. periodical variation of the electrical action following impression of the AC developing bias.

The developing sleeve 1 may be prepared by applying an electrically conductive covering over the surface of an electrically insulative support cylinder or by applying an electrically insulative covering on the surface of an electrically conductive support cylinder, and may be arranged to be driven for rotation in any desired direction depending on necessity.

On the other hand, the magnetic roller 2 may be driven for rotation in a direction opposite (i.e. in the clockwise direction) to that in FIG. 7, but it is necessary that the developing material should be transported in the clockwise direction in FIG. 7 through relative movement between the developing sleeve 1 and the magnetic roller 2.

It should further be noted that the developing material to be employed is not limited to a mono-component developing material as described earlier, but a dual-component developing material may also be adopted as well, with the same effect being available.

Figure 13:
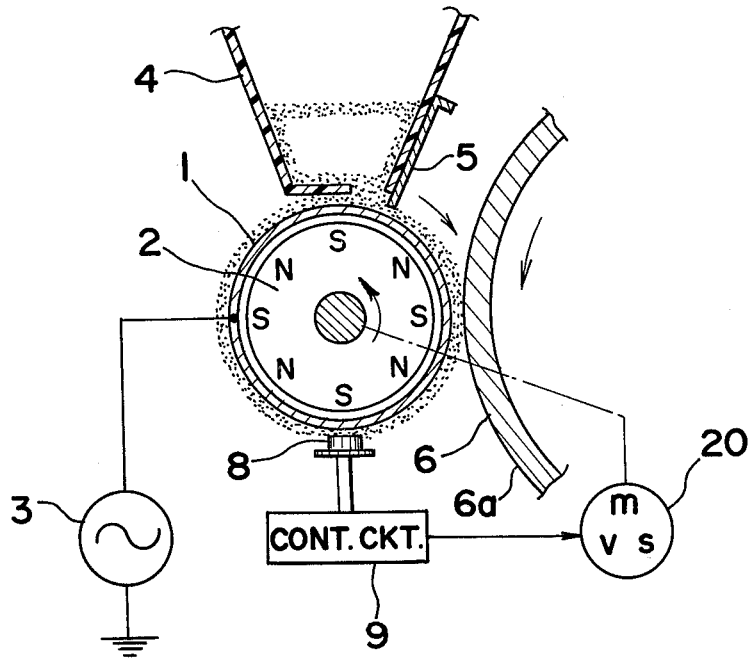
FIG. 13 is a view similar to FIG. 7, which particularly shows a second embodiment thereof.

Referring to FIG. 13, there is shown a second embodiment of the magnetic brush developing apparatus according to the present invention. In this embodiment, the disposition of the developing sleeve 1, magnetic roller 2, developing tank 4, bristle height adjusting plate 5 and photoreceptor drum 6, etc. is generally similar to that in the arrangement of FIG. 2, with like parts in FIG. 2 being designated by like reference numerals for brevity of description. In FIG. 13, the frequency of the AC power source 3 is set at 450 Hz, while the speed of rotation of the magnetic roller 2 is maintained at 1350 r.p.m. through the control circuit 9' coupled to the magnetic force variation detecting element 8 as described with reference to FIG. 7, a variable motor 20 coupled to the control circuit 9' being employed as a driving means for the magnetic roller 2. The magnetic force variation detecting element 8 in the above embodiment may be replaced by the photoelectric element 19 described as employed in the arrangement of FIGS. 11 and 12.

Although the frequency of the AC power source 3 and the speed of rotation of the magnetic roller 2 should normally be controlled in association with each other as shown in FIG. 7, no problem is caused even by the embodiment of FIG. 13, since fluctuation in the frequency of the AC power source is substantially equal to zero.

In the above embodiment of FIG. 13, since the period $t_1$ of the variation of the magnetic action due to rotation of the magnetic roller 2 and the period $t_2$ of the variation of the electrical action due to impression of the AC developing bias are represented by $t_1=50/9$ msec. and $t_2=20/9$ msec., while the integers n and m are n=2 and m=5, the period of developing force peak value becomes 11.11 . . . msec., which is smaller tha the substantial developing time (25 msec.) as required.

As is clear from the foregoing description, according to the present invention, since the period of the developing force peak value produced by the superposition of the magnetic action which periodically varies due to the rotation of the magnetic roller acting on the developing material located in the developing region, and the electrical action which also periodically varies due to the impression of the AC developing bias, is set to be no longer than the substantial developing time, the undesirable uneven development resulting from the simultaneous use of the magnetic roller driving system and the AC developing bias impressing system can be advantageously eliminated, and thus, developed images of favorable image quality may be obtained at high density through utilization of merits of the above systems.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be contrued as being included therein.

What is claimed is:

1. A method of developing electrostatic latent images formed on a surface of an electrostatic latent image support member through employment of a magnetic brush developing device having a developing sleeve to be impressed with an AC developing bias and a magnetic roller provided in said developing sleeve so as to be driven for rotation in said developing sleeve, said method comprising the step of setting the speed of rotation of the magnetic roller and the frequency of the AC developing bias so as to satisfy conditions represented by the following equations, $$nt_1=mt_2 \quad (1)$$

$$nt_1(mt_2)\leqq TD \quad (2)$$

where $t_1$: period (m sec.) of variation of the magnetic action due to rotation of the magnetic roller, $t_2$: period (m sec.) of variation of the electrical action due to the impression of the AC developing bias, n, m: integers having no common divisor other than 1, Td: substantial developing time (m sec.), and which is the time required for a point on the surface of the electrostatic latent image support member to pass a developing region where the electrostatic latent image is substantially developed, whereby the period of the developing force peak value is set so as to be no longer than the substantial developing time.

2. A method as claimed in claim 1, further comprising the step of detecting magnetic force variation owing to rotation of said magnetic roller, by a magnetic force variation detecting means, and amplifying the output from said detecting means by a control circuit coupled to said detecting means and applying the output to a high voltage transformer which impresses the AC developing bias on said developing sleeve.

3. A method as claimed in claim 2, wherein said detecting step comprises detecting the magnetic force variation by a magnetic force detecting element such as a Hall element and an inductance element.

4. A method as claimed in claim 2, wherein said detecting means comprises a rotary disc formed with an plurality of openings corresponding in positions to those of magnetic poles of said magnetic roller and fixedly mounted on a shaft of said magnetic roller for simultaneous rotation with said shaft and magnetic roller, and a light source and a photoelectric element provided at opposite sides of said rotary disc so as to confront each other through each of said openings, whereby upon rotation of said magnetic roller, said photoelectric element is actuated by light from the light source intermittently passing through said openings of said rotary disc rotating as one unit with said magnetic roller for detection of the magnetic force variation.

5. A method as claimed in claim 1, further comprising the step of detecting magnetic force variation owing to rotation of said magnetic roller by a magnetic force variation detecting means, and maintaining the speed of rotation of the magnetic roller at a predetermined value by controlling the driving motor for the magnetic roller by a control circuit in response to the output of said detecting means, while applying an AC developing bias at a predetermined frequency to said developing sleeve.

6. A method of developing electrostatic latent images formed on a surface of an electrostatic latent image support member through employment of a magnetic brush developing device having a developing sleeve to be impressed with an AC developing bias and a magnetic roller provided in said developing sleeve so as to be driven for rotation in said developing sleeve, said method comprising the step of controlling the speed of rotation of the magnetic roller and the frequency of the AC developing bias in association with each other so as to satisfy conditions represented by the following equations, $$nt_1=mt_2 \quad (1)$$

$$nt_1(mt_2)\leqq Td \quad (2)$$

where $t_1$: period (m sec.) of variation of the magnetic action due to rotation of the magnetic roller, $t_2$: period (m sec.) of variation of the electrical action due to the impression of the AC developing bias, n, m: integers having no common divisor other than 1, Td: substantial developing time (in sec.), and which is the time required for a point on the surface of the electrostatic latent image support member to pass a developing region where the electrostatic latent image is substantially developed, whereby the period of developing force peak value is controlled so as to be no longer than the substantial developing time.

* * * * *